US007032971B2

(12) United States Patent
Williams

(10) Patent No.: US 7,032,971 B2
(45) Date of Patent: Apr. 25, 2006

(54) SEAT BACKS

(76) Inventor: David Nicholas Lewis Williams, Maddox Design, 63 Main Road, Portskewett, Gwent NP6 4UG (GB)

( * ) Notice: Subject to any disclaimer, the term of this patent is extended or adjusted under 35 U.S.C. 154(b) by 0 days.

(21) Appl. No.: 10/471,839

(22) PCT Filed: Mar. 14, 2002

(86) PCT No.: PCT/GB02/01164

§ 371 (c)(1),
(2), (4) Date: Jan. 12, 2004

(87) PCT Pub. No.: WO02/071900

PCT Pub. Date: Sep. 19, 2002

(65) Prior Publication Data

US 2004/0100139 A1 May 27, 2004

(30) Foreign Application Priority Data

Mar. 14, 2001 (GB) ..... 0106247

(51) Int. Cl.
*A47C 3/025* (2006.01)

(52) U.S. Cl. ..... 297/284.4; 297/452.31; 297/DIG. 2

(58) Field of Classification Search ..... 297/452.13, 297/452.14, 452.15, 452.29, 452.3, 452.31, 297/284.2, 284.4, 284.5, 284.9, 452.4, 452.34, 297/DIG. 2

See application file for complete search history.

(56) References Cited

U.S. PATENT DOCUMENTS

| | | | | | |
|---|---|---|---|---|---|
| 4,368,917 | A | * | 1/1983 | Urai | 297/452.54 |
| 4,418,958 | A | | 12/1983 | Watkin | |
| 4,533,174 | A | * | 8/1985 | Fleishman | 297/16.1 |
| 4,556,254 | A | | 12/1985 | Roberts | |
| 4,660,887 | A | * | 4/1987 | Fleming et al. | 297/448.2 |
| 4,679,848 | A | * | 7/1987 | Spierings | 297/230.14 |
| 4,856,846 | A | * | 8/1989 | Lohmeyer | 297/285 |
| 5,154,485 | A | * | 10/1992 | Fleishman | 297/446.1 |
| 5,299,851 | A | * | 4/1994 | Lin | 297/284.5 |
| 5,328,245 | A | * | 7/1994 | Marks et al. | 297/284.3 |

(Continued)

FOREIGN PATENT DOCUMENTS

WO 96/07344 3/1996

*Primary Examiner*—Milton Nelson, Jr.
(74) *Attorney, Agent, or Firm*—Young & Thompson

(57) ABSTRACT

The core (1) of a seat back, which will be upholstered to form the complete back, is a moulded plastics sheet bowed forwardly and with attachment points (12) near top and bottom for securing to a rigid support. The sheet is constructed to be stiffer over its upper portion then over the lower and, when secured, to be able to ripple or alter its curvature between the attachment points. It may have wings (2) inclining forwardly at each side with closed end slots (3) between the wings (2) and the central zone (8) of the core. The wings can be divided into generally horizontal sections carried by integrally moulded transverse ribs (4) spanning the slots (3), the division between sections being by slots (13) or narrow membranes (6). The top of the core may also be divided into side-by-sections, the division being by slots (14) or narrow membranes (11).

20 Claims, 4 Drawing Sheets

U.S. PATENT DOCUMENTS 5,518,294 A 5/1996 Ligon
5,649,739 A * 7/1997 Zapf ..... 297/301.1
5,716,098 A 2/1998 Lance
5,906,416 A * 5/1999 Rasmussen ..... 297/452.33
5,934,752 A * 8/1999 Klingler ..... 297/284.4
5,951,110 A 9/1999 Conner et al.
6,079,785 A 6/2000 Peterson
6,378,942 B1 * 4/2002 Chu ..... 297/284.4
6,409,268 B1 * 6/2002 Cvek ..... 297/452.29
2002/0043842 A1 * 4/2002 Nakamori ..... 297/284.5

* cited by examiner

SEAT BACKS

BACKGROUND OF THE INVENTION

This invention relates to seat backs, and in particular to the core which generally defines its shape and characteristics. This core will generally be upholstered or sheathed in some way, but how the seat back supports the user and responds to his movements is dictated by the core.

Between the extremes of a rigid seat back and a fully upholstered one with internal springs, there are backs with a basic shape against which a user's back will fit comfortably but which will flex to a certain extent when the user moves, in effect trying to accommodate to a different posture. They will also change shape a bit between users of different physique.

One particular characteristic is the forward bow of the central part of the seat back, which gives support to the user's lumbar region. It has been recognised that it is desirable for the shape of this bowed part to be adjustable and there have been various proposals for altering this shape by some control mechanism. That is, the user can turn a knob, press a switch, or otherwise initiate some mechanical action that will pull or push the seat back into a different configuration. These may well work quite satisfactorily, but they make for complexity and therefore extra cost, and the user's control, if reasonably accessible, can spoil the otherwise "clean" lines of the seat.

It is the aim of this invention for the core of a seat back to be so constructed that it will accommodate well to different users and to different positions of users, while maintaining comfortable support, without extraneous control devices.

SUMMARY OF THE INVENTION

According to the present invention a seat back core comprises a molded plastics sheet bowed forwardly in vertical section and with fixing points on the rear side near top and bottom for attachment to a rigid seat member, the back being more resistant to bending over its upper part than its lower part.

In the preferred form the sheet has side wings inclined forwardly from narrow zones of weakness within the boundary of the sheet, symmetrically disposed either side of a vertical center line and generally parallel thereto. These zones of weakness are conveniently formed by closed end slots, and the wings and the central portion of the core between the slots will generally be connected by bridges across the slots. Advantageously, these bridges are parts of transverse ribs integrally molded on the rear side of the sheet.

For further comfort the wings may be divided into generally horizontal sections each capable of limited flexure with respect to the or each adjacent section. The division between wing sections is preferably by slots extending from the edge of the sheet to the adjacent zone of weakness, although it may be by expandable membranes integrally molded with the sheet and extending from the edge of the sheet to the adjacent zone of weakness.

The top edge portion of the core, beyond the zones of weakness, may also be divided into side-by-side sections each capable of limited flexure with respect to the or each adjacent section. And as with the wing sections the division between top edge portion sections is preferably by generally vertical slots extending down from the top edge of the core although it may be by generally vertical, narrow, integrally molded expandable membranes.

The differential resistance to bending may be caused by further ribs extending substantially vertically between transverse ribs in the upper part of said central zone. Alternatively, it may be caused by locally reducing the thickness of the sheet by transverse grooves and/or scored lines across the lower part of the said central zone.

BRIEF DESCRIPTION OF THE DRAWINGS

For a better understanding of the invention some embodiments will now be described, by way of example, to the accompanying drawings, in which.

DETAILED DESCRIPTION OF THE PREFERRED EMBODIMENTS

The backrest 1 of FIGS. 1 to 4 is of molded plastics such as nylon and has the general shape of a shield bowed forwards in vertical section and with side wings 2 curving further forwards. There are two closed end slots 3 extending vertically and symmetrically, one at either side of the vertical center line and stopping well short of the top and bottom edges of the shield. There could be thin membranes instead of the slots 3, making narrow zones of weakness, but for ease of manufacture slots are preferred.

Figure 1:
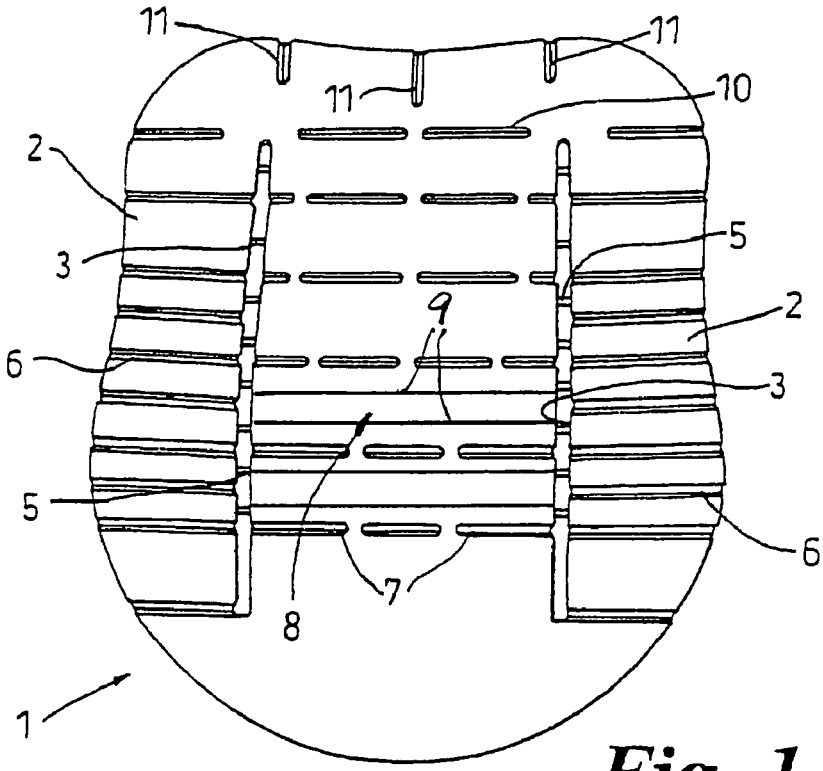
FIG. 1 is a front view of a backrest for a seat.
Figure 2:
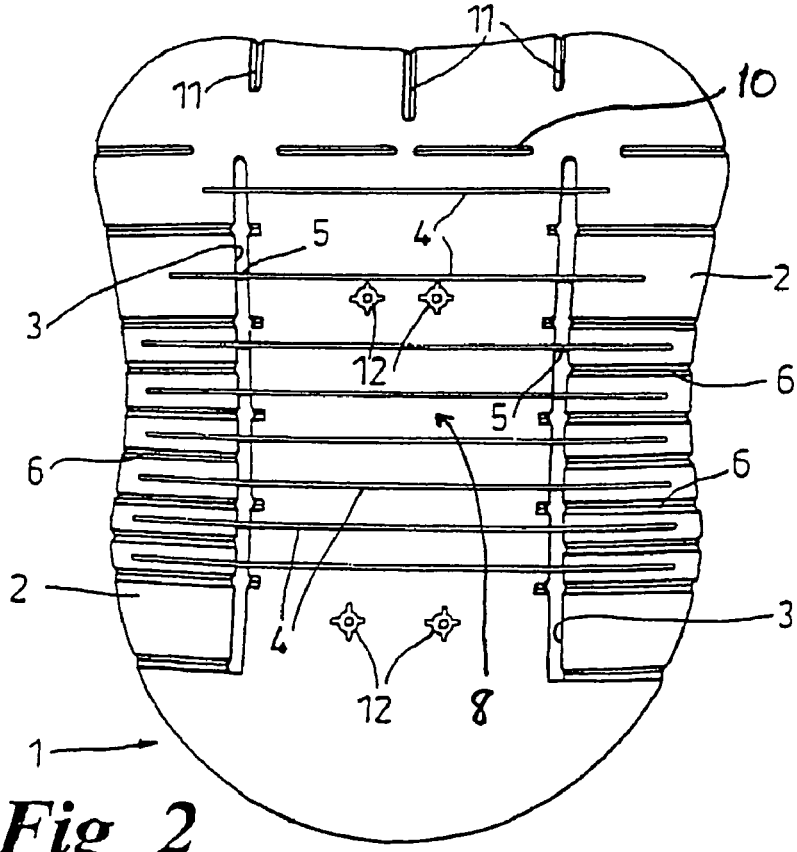
FIG. 2 is a rear view of the backrest of FIG. 1
Figure 3:
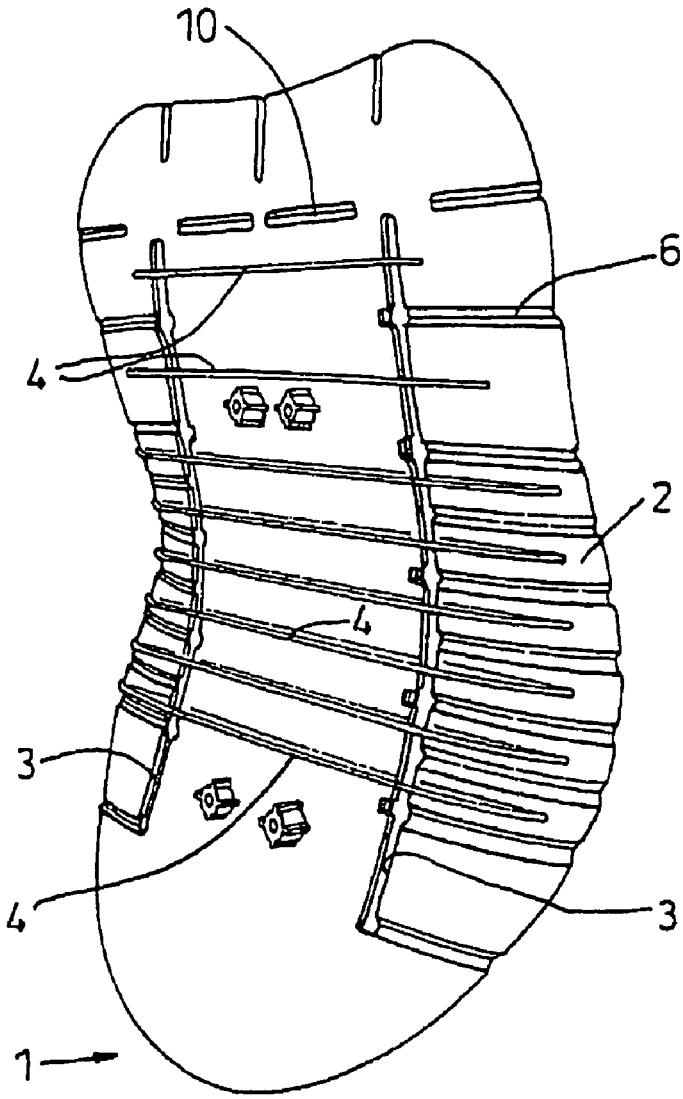
FIG. 3 is a perspective view showing the rear of the backrest.
Figure 4:
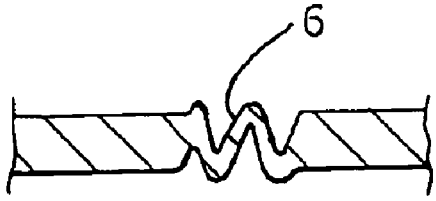
FIG. 4 is a sectional detail.

Integrally molded reinforcing ribs 4 extend horizontally across the backrest spanning the slots 3, and in doing so they form bridges 5. They do not start until about one third of the way up the shield, where they are clustered closer together than towards the top. Outside the slots 3 in the wings 2 of the shield there are horizontal webs or elongate membranes 6 alternating with the ribs 4. They are created by thinning and/or corrugating the material on both sides, an example of which is shown in the section of FIG. 4. There are also webs 7 in the central zone 8 between the slots 3, these being created by horizontal grooves in the front side only. They are, not continuous, and they are aligned with only some webs 6 in the wings 2. Between them, over part of the central zone 8, there are lines 9 scored parallel to the webs 7 in the sheet material which give a bit of extra flexibility.

Beyond the upper ends of the slots 3 there is another intermittent web 10, visible on both sides of the shield, and above that three webs or elongate corrugated membranes 11 extending down from the upper edge of the shield, one central and slightly longer than the two others, which are just inward of the slots 3.

On the rear face of the shield in the central zone 8 between the slots 3 there are four fixing points 12 where the shield is attached to a rigid support. Their arrangement is symmetrical with respect to the vertical centre line, with one pair near the top of the zone 8 and the other pair near the bottom of that zone, the points of each pair being quite close together so that the backrest can be secured to a single supporting spine or narrow frame upstanding from the rear of the seat. While these attachment points are fixed, the rest of the shield can move slightly under the constraints imposed by the stiffness of the material and the ribs and the amount of freedom allowed by the webs. But in particular, there is a capacity to "ripple" or alter its curvature from top to bottom or vice versa.

This construction is not easy to manufacture, the webs in particular being tricky. The embodiment of FIGS. 5 to 7 may therefore be preferred in practice.

Figure 5:
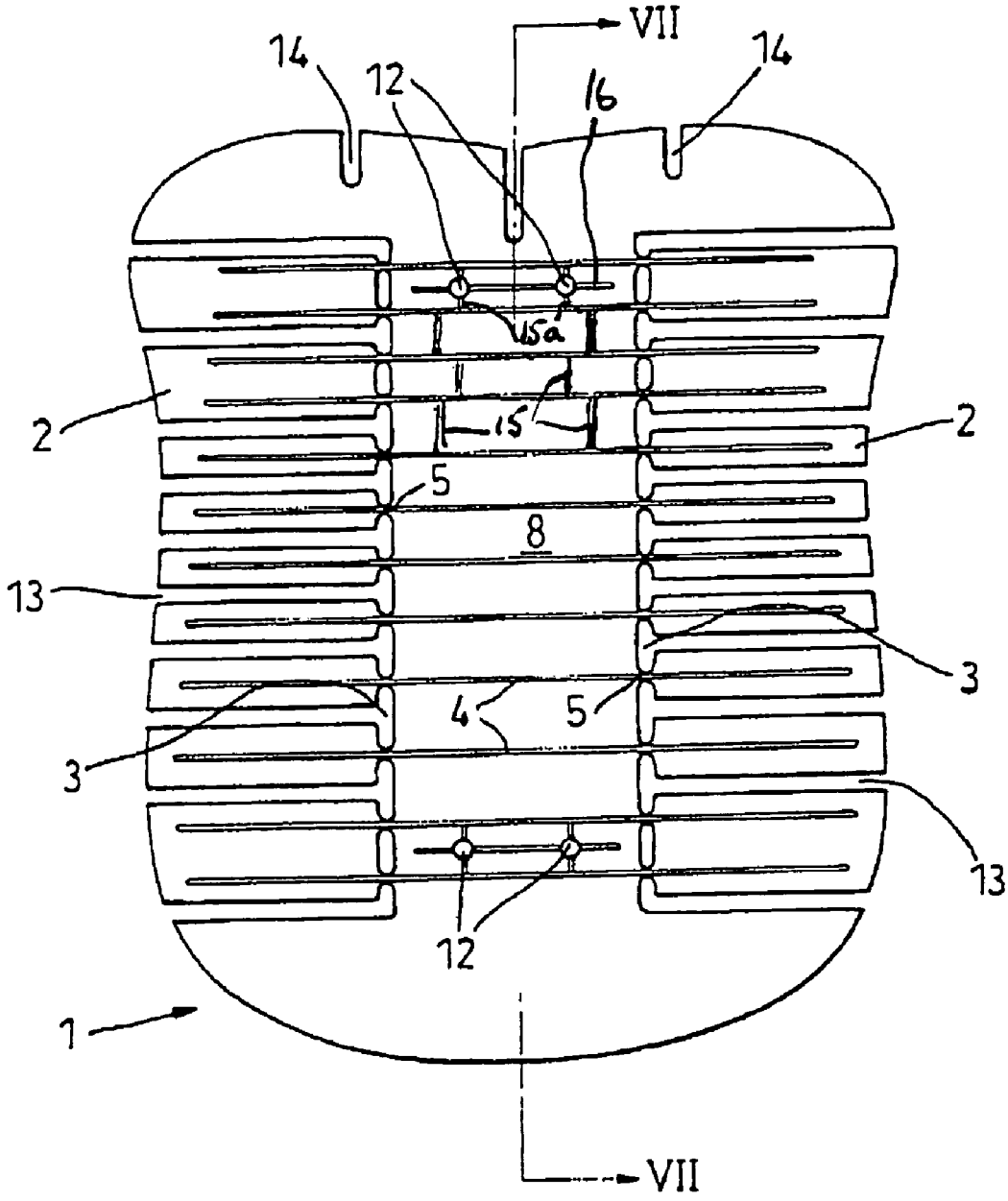
FIG. 5 is a rear view of another backrest
Figure 6:
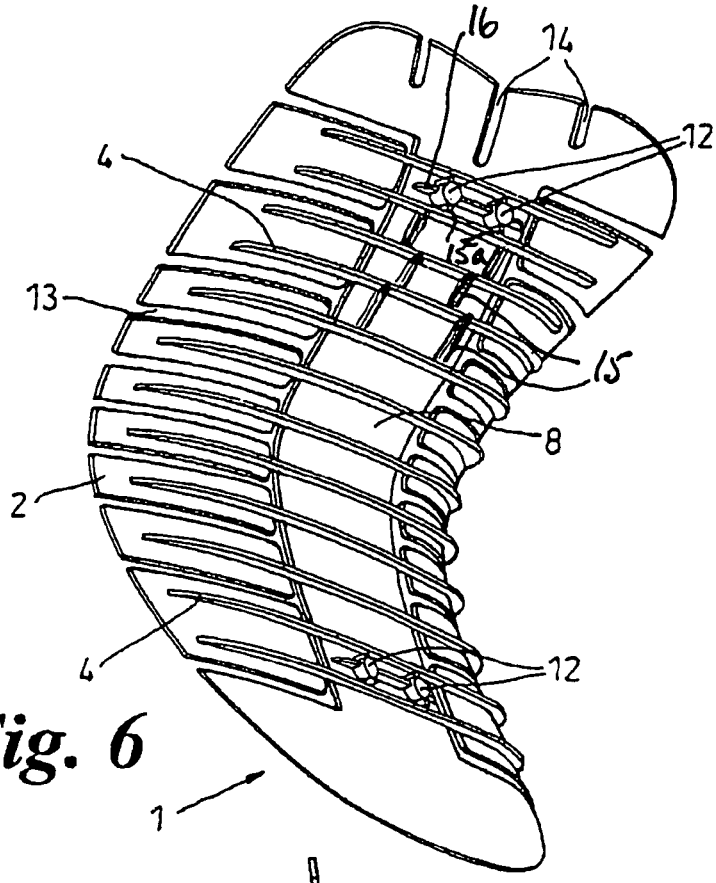
FIG. 6 is a perspective view showing the rear of the backrest of FIG. 5.
Figure 7:
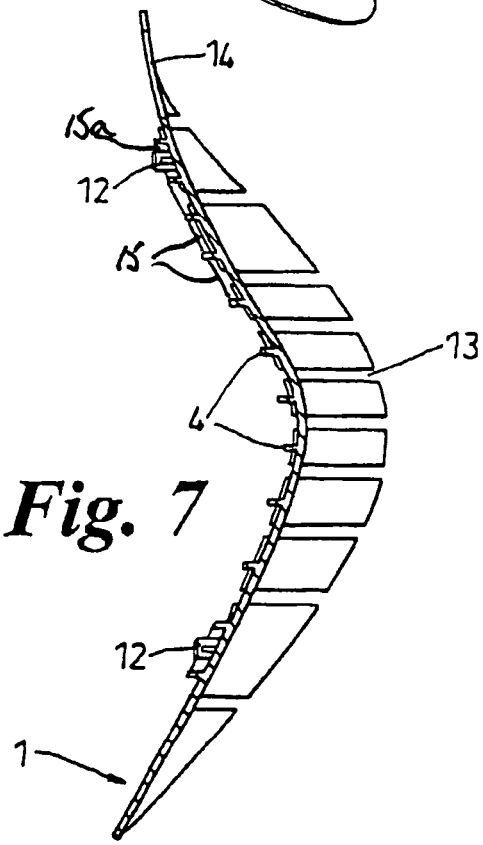
FIG. 7 is a section on the line VII—VII of FIG. 5.

Equivalent parts are similarly referenced. Much of the difference lies in having slots 13 and 14 instead of the webs 6 and 11 and in omitting the webs 7 and scored lines 9. The function of the latter was to give greater flexibility to the lower part of the central section 8, the upper part remaining relatively stiff. While the lower part should ripple quite easily, the upper part should have more limited capacity to deform. To maintain these different characteristics between the upper and lower parts, the material of the upper part could be thicker than that of the lower part, but preferably, as shown in FIGS. 5, 6 and 7, at least some of the ribs 4 spanning the upper part are joined by further vertical ribs 15 symmetrical with respect to the vertical center line. It will be understood that the number, size and distribution of these ribs can vary from what is shown, to tailor the flexibility of the core with some precision.

Two ribs 15*a* extend between the two uppermost ribs 4 and incorporate the upper fixing points 12, which are also incorporated in a short transverse rib 16. This reinforces the core in the upper zone of attachment and there is similar reinforcement in the lower zone. That has a very short vertical extent and it does not affect the ability of the core to ripple above the second lowermost transverse rib 4.

The slots 3 are shown as straight and parallel. This may be varied, for example by having them slightly divergent or curved.

Provision may be made for setting up the backrest with a different curvature. For example, there could be an extra pair of fixing points immediately below the lower pair, and by attaching the spine to this extra pair the forward bow of the zone 8 will be made more pronounced than with attachment to the original lower pair.

The invention claimed is:

1. A seat back core comprising:

a molded plastic sheet having a forward side and a rear side, a central zone of said sheet having a bowed region that is bowed forwardly;

plural fixing points on the rear side of said sheet that define a top and a bottom of said bowed region and that are for attachment to a rigid seat member, said bowed region being more resistant to bending over its upper part than its lower part, said bowed region is arranged to ripple in response to urging by a seated user's back; and side wings directly connected to said bowed region at narrow zones of weakness, said side wings being symmetrically disposed on either side of a vertical center line and generally parallel to the center line, said side wings being divided into generally horizontal sections each capable of flexure with respect to an adjacent section and being inclined forwardly.

2. The seat back core as claimed in claim 1, wherein each of said narrow zones of weakness is a connection member extending laterally from said bowed region.

3. A seat back core as claimed in claim 1, wherein the differential resistance to bending is caused by locally reducing the thickness of the sheet by at least one of transverse grooves and scored lines across the lower part of said central zone.

4. A seat back core as claimed in claim 1, further comprising bridges connecting the wings and a central portion of the seat back core.

5. A seat back core as claimed in claim 4, wherein the bridges are parts of transverse ribs integrally moulded on the rear side of the sheet.

6. The seat back core as claimed in claim 1, wherein each of said narrow zones of weakness comprises a member having at least one of reduced thickness and reduced width with respect to a thickness and a width of said side wings.

7. A seat back core as claimed in claim 1, wherein the division between wing sections is by slots extending from the edge of the sheet to the adjacent zone of weakness.

8. A seat back core as claimed in claim 1, wherein the division between wing sections is by expandable membranes integrally molded with the sheet and extending from the edge of the sheet to the adjacent zone of weakness.

9. A seat back core as claimed in claim 1, wherein the top edge portion of the seat back core, beyond the zones of weakness, is divided into side-by-side sections each capable of limited flexure with respect to the adjacent section.

10. A seat back core as claimed in claim 9, wherein the division between top edge portion sections is by generally vertical slots extending down from the top edge of the core.

11. A seat back core as claimed in claim 9, wherein the division between top edge portion sections is by generally vertical, narrow, integrally molded expandable membranes.

12. A seat back core as claimed in claim 1, wherein the differential resistance to bending is caused by further ribs extending substantially vertically between transverse ribs in the upper part of said central zone.

13. A seat back core comprising:

a plastic sheet having a forward side and a rear side, said sheet being bowed forwardly and arranged to ripple in a central bowed region in response to urging by a seated user's back;

plural fixing points on the rear side of said sheet that define a top and a bottom of said bowed region;

connection members extending from said bowed region;

side wings directly connected to said bowed region by said connection members, said side wings being forwardly curved and being divided into generally horizontal sections that each flex with respect to an adjacent one of said generally horizontal sections; and a plurality of transverse ribs, a respective one of said plural ribs extending from a central portion of a corresponding one of said horizontal sections across said bowed region to an opposing central portion of another one of said horizontal sections.

14. A seat back core comprising:

a plastic sheet having a forward side and a rear side, said sheet being bowed forwardly and arranged to ripple in a central bowed region in response to urging by a seated user's back;

plural fixing points on the rear side of said sheet that define a top and a bottom of said bowed region; and side wings directly connected to said bowed region, said side wings being forwardly curved and being divided into generally horizontal sections that each flex with respect to an adjacent one of said generally horizontal sections.

15. The seat back core according to claim 14, wherein a respective closed vertical slot extends between said bowed region and a corresponding side wing, and further comprising a plurality of ribs bridging said respective vertical slot to connect said wings to said bowed region.

16. The seat back core according to claim 15, wherein a spacing between two immediately adjacent ribs increases from a bottom part of said bowed region to a top part of said bowed region.

17. The seat back core according to claim 14, wherein each of said generally horizontal sections are connected to an adjacent one of said horizontal sections by a corrugated membrane.

18. The seat back core as claimed in claim 14, wherein each of said generally horizontal sections are connected to an adjacent one of said horizontal sections by an expandable membrane integrally molded with the sheet and extending from a tip of said respective wing section to a corresponding point of connection of said respective wing section to the bowed region.

19. The seat back core as claimed in claim 14, further comprising at least one of transverse grooves and scored lines across a lower part of a forward side of said bowed region.

20. The seat back core according to claim 14, further comprising a plurality of substantially horizontally extending grooves only on said forward side.

* * * * *